US005699843A

United States Patent [19]

Gagné

[11] Patent Number: 5,699,843

[45] Date of Patent: Dec. 23, 1997

[54] MULTI-DRUM BARKING MACHINE

[76] Inventor: Éric Gagné, 55, Chassé, St-Anaclet, Rimouski, Québec, Canada, G0K 1H0

[21] Appl. No.: 738,064

[22] Filed: Oct. 25, 1996

[30] Foreign Application Priority Data

Sep. 20, 1996 [CA] Canada ..... 2186098

[51] Int. Cl.[6] ..... B27C 9/00; B27L 1/00

[52] U.S. Cl. ..... 144/208.9; 144/341

[58] Field of Search ..... 144/208.1, 208.3, 144/208.9, 340, 341

[56] References Cited

U.S. PATENT DOCUMENTS

| | | | |
|---|---|---|---|
| 1,319,935 | 10/1919 | Thorne | 144/208.9 |
| 1,966,153 | 7/1934 | Thorne | 144/208.9 |
| 2,125,529 | 8/1938 | Ullgren | 144/208.9 |
| 2,647,548 | 8/1953 | Guettler | 144/208.9 |
| 3,866,639 | 2/1975 | Kantola et al. | 144/241.3 |
| 4,295,507 | 10/1981 | Karlsson | 144/208.9 |
| 4,582,106 | 4/1986 | Huhta et al. | 144/208.3 |
| 4,685,498 | 8/1987 | Nakajima et al. | 144/208.9 |
| 4,691,750 | 9/1987 | Nakajima | 144/208.9 |

FOREIGN PATENT DOCUMENTS

| | | | |
|---|---|---|---|
| 1225309 | 8/1987 | Canada . | |
| 1261714 | 9/1989 | Canada . | |
| 285215 | 10/1970 | U.S.S.R. | 144/208.9 |

*Primary Examiner*—W. Donald Bray

[57] ABSTRACT

A barking machine comprises a container for accommodating logs longitudinally therein, this container having a longitudinal side wall with a lower end, and a bottom wall including a first longitudinal opening adjacent to the lower end of the first side wall, a second intermediate longitudinal opening, and a third longitudinal opening. First, second and third longitudinal drum members are rotatively mounted in the first, second and third longitudinal openings, respectively, to expose a top portion thereof inside the container. A plurality of outer barking teeth are distributed on the rotary drum members to contact the logs and thereby bark these logs. Finally, a drive system rotates the drum members in the same direction for moving the barking teeth of the top portion thereof toward the longitudinal side wall. The bottom wall and the rotary drum members form a wall and drum member assembly having a greater slope from the first to the second drum member and a smaller slope from the second to the third drum member.

8 Claims, 4 Drawing Sheets

MULTI-DRUM BARKING MACHINE

BACKGROUND OF THE INVENTION

1. Field of the Invention

The present invention relates to a barking machine for barking logs more efficiently, fully and quickly.

2. Brief Description of the Prior Art

Many multi-drum barking machines have been proposed in the prior art. Examples are shown and described in Canadian patents Nos. 1,225,309 (Nakajima et al.) issued on Aug. 11, 1987, and 1,261,714 (Nakajima) granted on Sep. 9, 1989.

A major drawback of the prior art multi-drum barking machines is that they lack efficiency. A lot of time is required for the barking operation and barking is not as complete as it should be.

OBJECT OF THE INVENTION

An object of the present invention is therefore to provide a barking machine capable of overcoming the above discussed drawbacks of the prior art.

SUMMARY OF THE INVENTION

More specifically, in accordance with the present invention, there is provided a barking machine comprising (a) a container for accommodating logs longitudinally therein, (b) first, second and third longitudinal rotary drum members, (c) a plurality of outer barking teeth distributed on the rotary drum members to contact the logs as the rotary drum members rotate to bark these logs, and (d) means for rotating the rotary drum members in the same direction. The container has a first longitudinal side wall with a lower end, a second longitudinal side wall opposite to the first longitudinal side wall, and a bottom wall including a first longitudinal opening adjacent to the lower end of the first side wall, a second intermediate longitudinal opening, and a third longitudinal opening situated on the side of the second longitudinal opening opposite to the first longitudinal opening. The first, second and third longitudinal rotary drum members are rotatively mounted in the first, second and third longitudinal openings, respectively, to expose a top portion thereof inside the container. Rotation of the drum members in the same direction displaces the barking teeth of the top portion of the rotary drum members in the direction of the first side wall. Therefore, the bottom wall and the rotary drum members form a wall and drum member assembly having a first slope from the first drum member to the second drum member and a second slope smaller than the first slope from the second drum member to the third drum member.

Upon rotation of the drum members in the same direction, the teeth of the exposed top portions of these drum members move toward the first longitudinal side wall while contacting, scratching and rubbing the logs in view of barking the same. Since the bottom wall and the rotary drum members form a wall and drum member assembly having a first slope from the first drum member to the second drum member, and a second slope smaller than the first slope from the second drum member to the third drum member, and since the first rotary drum member is situated in the first longitudinal opening adjacent to the lower end of the first side wall, the teeth of the third rotary drum member move the lower logs laterally on the second slope from the third rotary drum member to the second rotary drum member. Then, the teeth of the second rotary drum member pushes the lower logs on the second slope. Finally, the teeth of the first rotary drum member pushes the lower logs upwardly. This sequence of operation imparts to the logs a circular movement which enables the teeth of the rotary drum members to efficiently and more fully bark all the logs, and that in a shorter period of time.

In accordance with preferred embodiments:

- the first, second and third rotary drum members are rotatable about first, second and third parallel rotation axes, respectively;
- the first and second rotation axes are lying into a first plane defining an angle of approximately 25° with the horizontal;
- the second and third rotation axes are lying into a second plane defining an angle of approximately 12° with the horizontal;
- the barking teeth of the first, second and third rotary drum members each have a semicircular toothed surface centered onto the first, second and third rotation axes, respectively; and
- the top portion of the first rotary drum member is located adjacent to an inner face of the first longitudinal side wall.

The objects, advantages and other features of the present invention will become more apparent upon reading of the following non restrictive description of a preferred embodiment thereof, given by way of example only with reference to the accompanying drawings.

DETAILED DESCRIPTION OF THE PREFERRED EMBODIMENT

In the appended drawings, the barking machine is generally identified by the reference 10.

Figure 1:
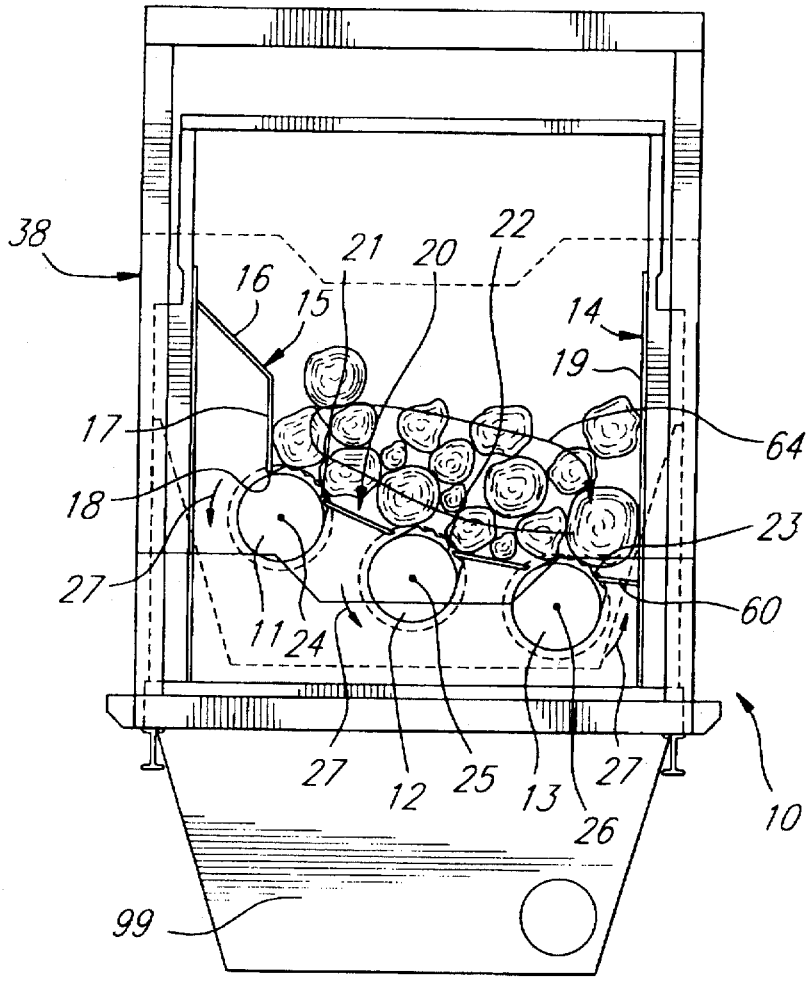
FIG. 1 is an elevational, end view of a preferred embodiment of the barking machine according to the present invention.

Referring to FIG. 1, the barking machine comprises a container 14 mounted onto a metal frame 38, and a set of three generally parallel, elongated, and longitudinal rotary drum members 11, 12 and 13.

Still referring to FIG. 1, the container comprises a first longitudinal side wall 15 formed of an upper inclined wall portion 16 and a generally vertical lower portion 17 with a lower end 18. The container 14 further comprises a second generally vertical longitudinal side wall 19 opposite to the side wall 15, and a sloping bottom wall 20.

The bottom wall 20 defines three longitudinal, generally parallel openings 21, 22 and 23. The first longitudinal opening 21 is adjacent to the lower end 18 of the side wall 15. Opening 22 is an intermediate longitudinal opening. Longitudinal opening 23 is situated on the side of opening 22 opposite to opening 21.

The rotary drum member 11 is rotatively mounted in longitudinal opening 21 so as to expose a top portion thereof inside the reservoir 14 adjacent to the inner face of the longitudinal side wall 15. Rotary drum member 12 is rotatively mounted in the intermediate longitudinal opening 22 again to expose a top portion of drum member 12 inside the container 14. Finally, rotary drum member 13 is rotatively mounted in longitudinal opening 23 to expose its top portion inside the container 14.

As also illustrated in FIG. 1, drum member 11 rotates about an axis 24, drum member 12 rotates about an axis 25, and drum member 13 rotates about an axis 26, the rotation axes 24, 25 and 26 being parallel to each other.

Figure 2:
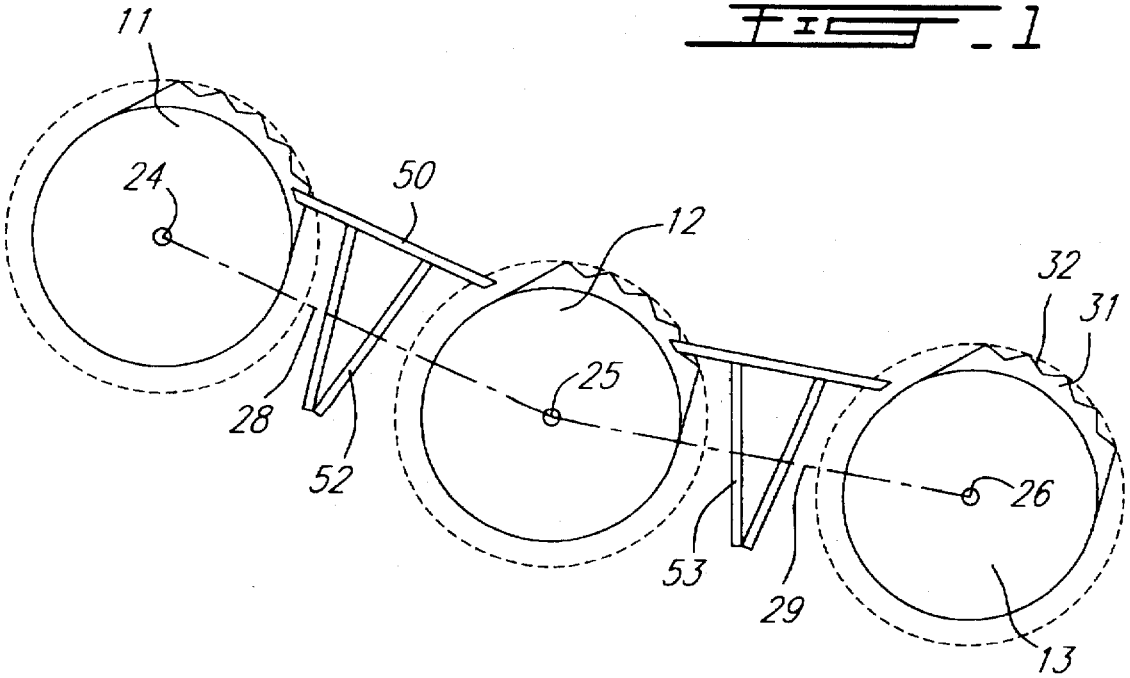
FIG. 2 is an elevational, partial and enlarged end view of three rotary drum members and a reservoir bottom wall forming part of the barking machine of FIG. 1.

As better illustrated in FIG. 2 of the appended drawings, the rotation axes 24 and 25 are lying into a first plane 28 defining an angle of approximately 25° with the horizontal (if we suppose that the axes 24 and 25 are horizontal). Regarding the rotation axes 25 and 26, they are lying into a second plane 29 defining an angle of approximately 12° with the horizontal (if we suppose that the axes 25 and 26 are horizontal).

Figure 3:
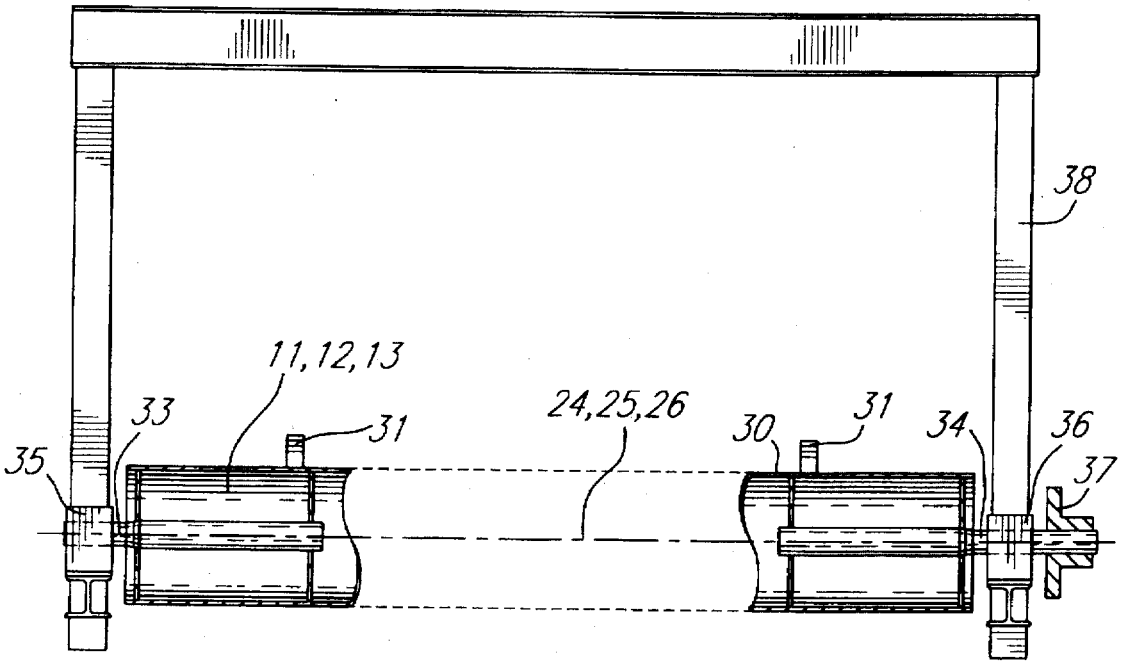
FIG. 3 is a side elevational view of one of the rotary drum members forming part of the barking machine of FIG. 1.
Figure 4:
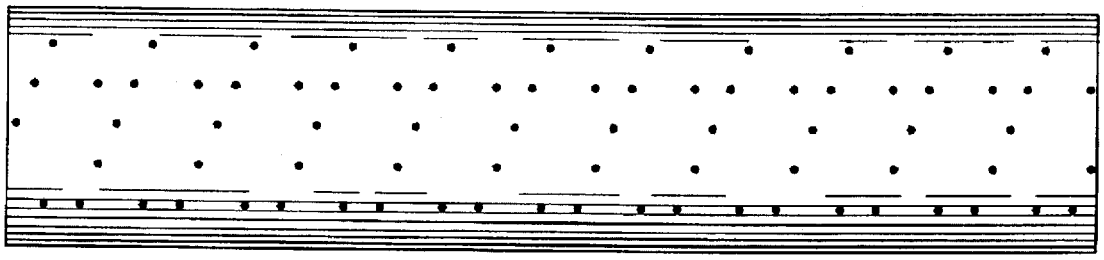
FIG. 4 is a planar representation of a cylindrical outer surface of the rotary drum members showing the distribution of barking teeth on that surface.

Referring to FIGS. 2 and 3, each rotary drum member 11, 12 or 13 comprises an outer cylindrical surface 30 on which outer barking teeth such as 31 are mounted. The outer barking teeth 31 are distributed on the rotary drum member 11, 12 or 13 to contact the logs as the rotary drum member 11, 12 or 13 rotate in view of barking these logs. FIG. 4 is a planar representation of the cylindrical surface 30 of one rotary drum member 11, 12 or 13 showing an example of distribution of the teeth 31 on the latter surface. In FIG. 4, each dot indicates the presence of a tooth 31.

FIG. 2 shows that the barking teeth 31 of the rotary drum members 11, 12 and 13 each have a semicircular toothed surface 32 centered onto the rotation axes 24, 25 and 26, respectively.

Figure 5:
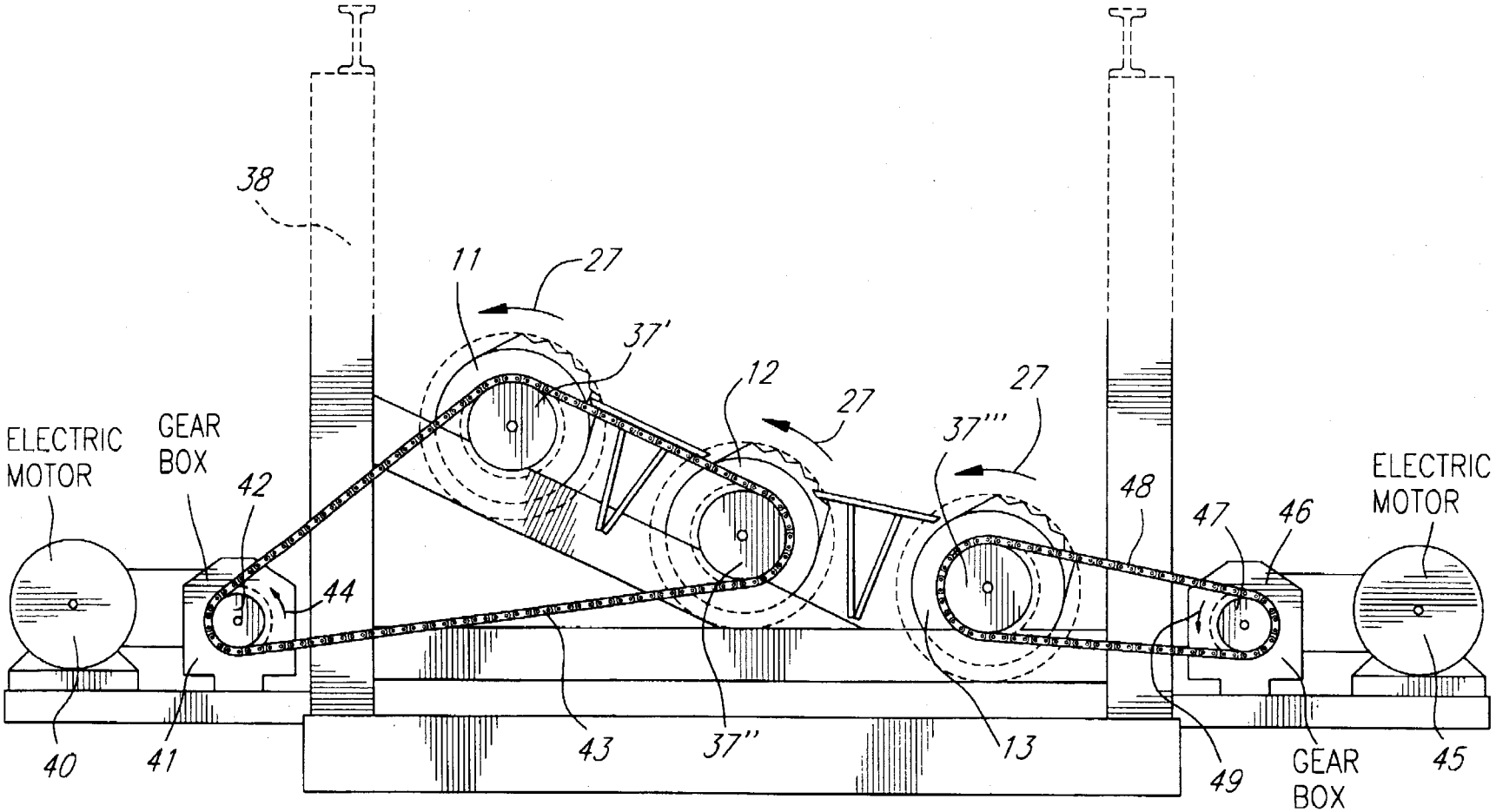
FIG. 5 is a schematic representation of a system for driving the rotary drum members.

An example of system for driving, that is rotating the three drum members 11, 12 and 13 in the same direction 27 is illustrated in FIG. 5.

Referring momentarily to FIG. 3, each rotary drum member 11, 12 or 13 comprises two opposite axial end shaft sections 33 and 34. The shaft sections 33 and 34 are mounted onto respective ball bearings 35 and 36, themselves mounted onto the metal frame 38, to ensure free rotational movement of the drum member 11, 12 or 13 about the corresponding axis 24, 25 or 26. Also, the end shaft section 34 extends beyond ball bearing 36 to receive a sprocket 37 through which the rotary drum member 11, 12 or 13 is driven.

Referring back to FIG. 5, the drive system comprises a first assembly including an electric motor 40 and a gear box 41 mounted onto the frame 38. Gear box 41 comprises a sprocket 42. In operation, the electric motor 40 drives the gear box 41 to transmit rotational movement to the sprocket 42. A chain 43 interconnects the sprocket 42 of gear box 41, the sprocket 37' of rotary drum member 11, and the sprocket 37" of rotary drum member 12. Accordingly, rotation of the sprocket 42 in direction 44 will simultaneously cause rotation of the drum members 11 and 12 in direction 27 through the sprockets 37' and 37".

The drive system further comprises a second assembly including an electric motor 45 and a gear box 46 mounted onto the frame 38. Gear box 46 comprises a sprocket 47. In operation, the electric motor 45 drives the gear box 46 to transmit rotational movement to the sprocket 47. A chain 48 interconnects the sprocket 47 of gear box 46 and the sprocket 37"' of rotary drum member 13. Accordingly, rotation of the sprocket 47 in direction 49 will cause rotation of the drum member 13 in direction 27 through the sprocket 37"'.

Rotation of the rotary drum members 11, 12 and 13 in the same direction 27 displaces the barking teeth of the top portions of these rotary drum members, located inside the container 14, in the direction of, that is toward the longitudinal side wall 15.

Of course, it is within the scope of the present invention to form each rotary drum member 11, 12 or 13 with many individual rotary drum members disposed end to end, and centered onto a common axis such as 24, 25 or 26. The drive system is then modified to adapt to such a structure.

As shown in FIG. 2, the bottom wall 20 comprises a metallic longitudinal bottom wall section 50 between the outer cylindrical surface of rotary drum member 11 and the outer cylindrical surface of rotary drum member 12, and a metallic longitudinal bottom wall section 51 between the outer cylindrical surface of rotary drum member 12 and the outer cylindrical surface of rotary drum member 13. Since the bottom wall sections 50 and 51 are supported only at the two ends thereof, they are reinforced by respective V-shaped metal members 52 and 53 welded to the underside of the wall section 50 and 51, respectively.

Figure 6:
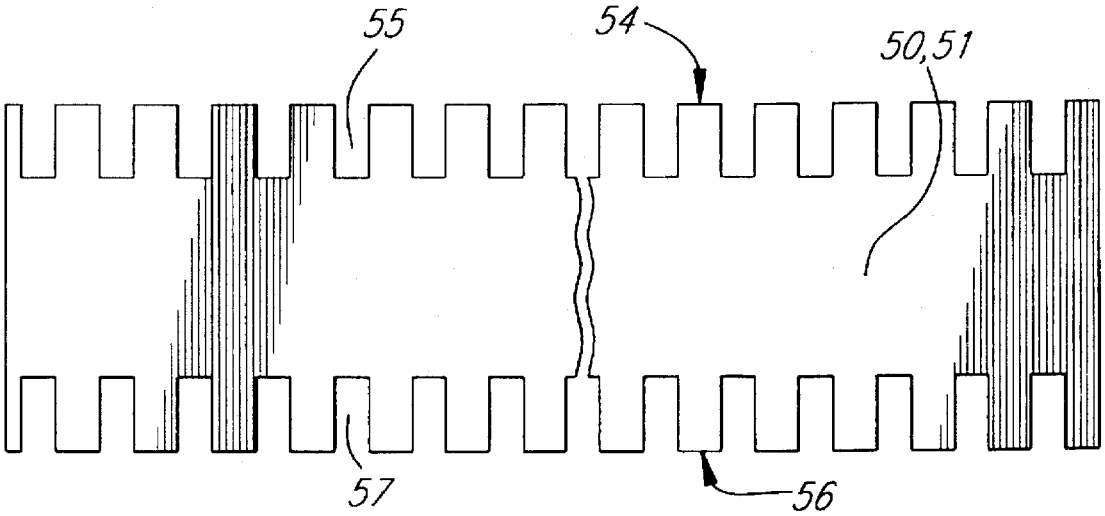
FIG. 6 is a plan view of longitudinal portions of the reservoir bottom wall showing opposite comb-like edge portions.

Referring to FIG. 6, both the bottom wall sections 50 and 51 comprise a comb-like edge portion 54 adjacent to the outer cylindrical surface of rotary drum member 11 and formed with notches such as 55 to enable passage of the barking teeth 31 of drum member 11, and a comb-like edge portion 56 adjacent to the outer cylindrical surface of rotary drum member 12 and comprising notches such as 57 to allow passage of the barking teeth 31 of drum member 12. Of course, the bottom wall sections 50 and 51 may be formed of many elongate wall sections as illustrated in FIG. 6, assembled end to end.

Figure 7:
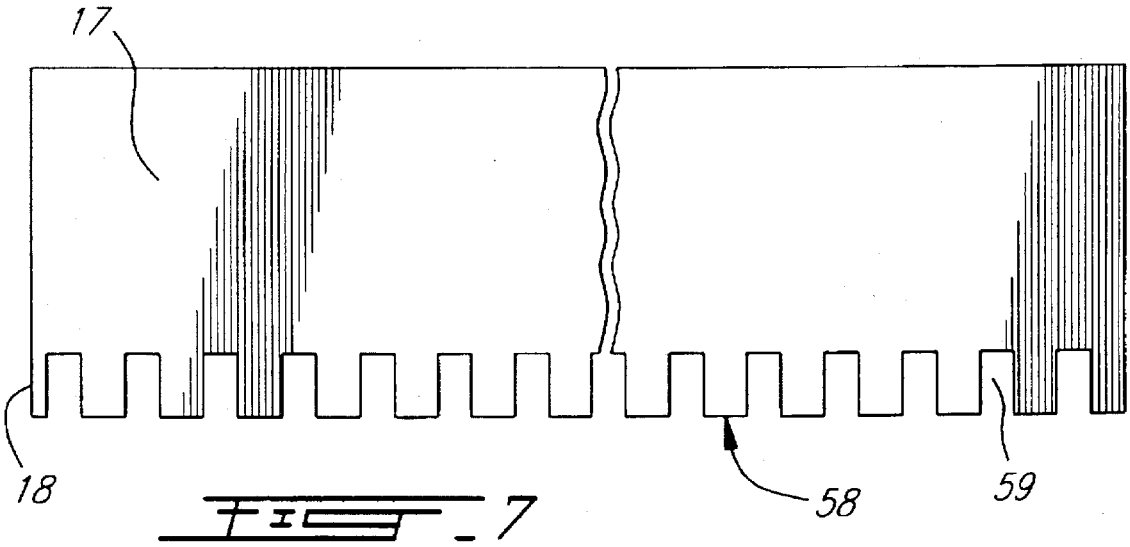
FIG. 7 is a side elevational view of a the lower end of a longitudinal side wall of the container, showing a comb-like lower edge portion.

FIG. 7 illustrates the generally vertical lower portion 17 of the longitudinal side wall 15. As can be seen, the lower end 18 of wall portion 17 is formed with a comb-like edge portion 58 adjacent to the outer cylindrical surface of rotary drum member 11 and formed with notches such as 59 to enable passage of the barking teeth 31 of drum member 11. Of course, the lower wall portion 17 may be formed of many elongate wall sections as illustrated in FIG. 7, assembled end to end.

Figure 8:
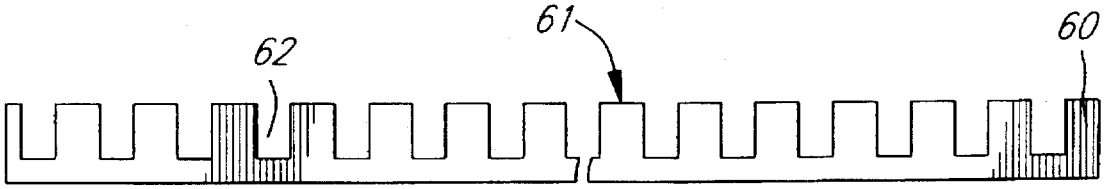
FIG. 8 is a plan view of a longitudinal portion of the reservoir bottom wall, showing a comb-like edge portion.

The bottom wall 20 finally comprises a longitudinal wall section 60 (FIGS. 1 and 8) situated between the generally vertical longitudinal side wall 19 and the cylindrical surface of rotary drum member 13. As illustrated in FIG. 8, the longitudinal bottom wall section 60 is formed with a comb-like edge portion 61 adjacent to the outer cylindrical surface of rotary drum member 13 and formed with notches such as 62 to enable passage of the barking teeth 31 of drum member 13. Of course, the longitudinal wall section 60 may be formed of many elongate wall sections as illustrated in FIG. 8, assembled end to end.

Referring back to FIG. 1, the container 14 is designed for accommodating logs such as 63 longitudinally therein. Upon rotation of the drum members 11, 12 and 13 in direction 27, the teeth 31 of the top portions of these drum members move toward the longitudinal side wall 15 while contacting, scratching and rubbing the logs 63 in view of barking the latter. Since the bottom wall 20 and the rotary drum members 11, 12 and 13 form a wall and drum member assembly having a first slope from drum member 11 to drum member 12, and a second slope smaller than the first slope from drum member 12 to drum member 13, and since rotary drum member 11 is situated in longitudinal opening 21 adjacent to the lower end 18 of the generally vertical wall portion 17 of the longitudinal side wall 15, the logs 63 follow a course identified by the reference 64.

More specifically, referring to FIG. 1, the teeth 31 of rotary drum member 13 move the lower logs 63 laterally on the slope of lower value, from rotary drum member 13 to rotary drum member 12. Then, the teeth 31 of the rotary drum member 12 pushes the lower logs 63 on the slope of larger value. Finally, the teeth of rotary drum member 11 pushes the lower logs 63 upwardly. The combined action of the rotary drum members and the two slopes of different values imparts to the logs a movement indicated by the course 64 of FIG. 1. This movement of the logs 63 enables the teeth 31 of the rotary drum members 11, 12 and 13 to efficiently and more completely bark these logs 63, of course in a shorter period of time.

In accordance with the present invention, the number of rotary drum members can be greater than three and the bottom wall and drum member assembly can define more than two slopes. Also, the two slopes can depart more or less from 12° and 25°.

In the barking machine, the end walls are optional. For example, the barking machine can be slightly inclined, the logs being fed at one end and discharging automatically at the other end.

Finally, the barking machine 10 may be provided with an underside reservoir 99 for collecting and accumulating bark for recycling or any other purpose.

Although the present invention has been described hereinabove with reference to a preferred embodiment thereof, this embodiment can be modified at will, within the scope of the appended claims, without departing from the spirit and nature of the subject invention.

What is claimed is:

1. A barking machine comprising:

a container for accommodating logs longitudinally therein, said container having a first longitudinal side wall with a lower end, a second longitudinal side wall opposite to the first longitudinal side wall, and a bottom wall including a first longitudinal opening adjacent to the lower end of the first side wall, a second intermediate longitudinal opening, and a third longitudinal opening situated on the side of the second longitudinal opening opposite to the first longitudinal opening;

first, second and third longitudinal rotary drum members rotatively mounted in the first, second and third longitudinal openings, respectively, to expose a top portion of said first, second and third rotary drum members inside the container;

a plurality of outer barking teeth distributed on the rotary drum members to contact the logs as said rotary drum members rotate to bark said logs; and means for rotating said rotary drum members in the same direction to displace the barking teeth of the top portion of the rotary drum members in the direction of the first side wall;

wherein said bottom wall and said rotary drum members form a wall and drum member assembly having a first slope from the first drum member to the second drum member and a second slope smaller than said first slope from the second drum member to the third drum member.

2. A barking machine as recited in claim 1, wherein:

the first, second and third rotary drum members are rotatable about first, second and third parallel rotation axes, respectively; and the first and second rotation axes are lying into a first plane defining an angle of approximately 25° with the horizontal; and the second and third rotation axes are lying into a second plane defining an angle of approximately 12° with the horizontal.

3. A barking machine as recited in claim 1, wherein the first slope has a value of approximately 25° and the second slope has a value of approximately 12°.

4. A barking machine as recited in claim 1, wherein the first, second and third rotary drum members each comprise an outer cylindrical surface on which respective ones of said barking teeth are mounted.

5. A barking machine as recited in claim 4, in which:

said bottom wall comprises a first bottom wall section between the outer cylindrical surface of the first rotary drum member and the outer cylindrical surface of the second rotary drum member;

said bottom wall comprises a second bottom wall section between the outer cylindrical surface of the second rotary drum member and the outer cylindrical surface of the third rotary drum member;

the first bottom wall section comprises a first comb-like edge portion adjacent to the outer cylindrical surface of the first rotary drum member and formed with notches to enable passage of the barking teeth of the first rotary drum member, and a second comb-like edge portion adjacent to the outer cylindrical surface of the second rotary drum member and comprising notches to enable passage of the barking teeth of the second rotary drum member; and the second bottom wall section comprises a third comb-like edge portion adjacent to the outer cylindrical surface of the second rotary drum member and formed with notches to enable passage of the barking teeth of the second rotary drum member, and a fourth comb-like edge portion adjacent to the outer cylindrical surface of the third rotary drum member and comprising notches to allow passage of the barking teeth of the third rotary drum member.

6. A barking machine as recited in claim 1, wherein the lower end of the first side wall is formed with a comb-like lower edge portion adjacent to the outer cylindrical surface of the first rotary drum member and formed with notches to enable passage of the barking teeth of said first rotary drum member.

7. A barking machine as recited in claim 1, wherein:

the first, second and third rotary drum members are rotatable about first, second and third rotation axes, respectively; and the barking teeth of the first rotary drum member each have a semicircular toothed surface centered onto the first rotation axis, the barking teeth of the second rotary drum member each have a semicircular toothed surface centered onto the second rotation axis, and the barking teeth of the third rotary drum member each have a semicircular toothed surface centered onto the third rotation axis.

8. A barking machine as recited in claim 1, wherein the top portion of the first rotary drum member is located adjacent to an inner face of the first longitudinal side wall.

* * * * *